US012264446B2

(12) United States Patent
Kannan et al.

(10) Patent No.: US 12,264,446 B2
(45) Date of Patent: Apr. 1, 2025

(54) ROAD OBSTACLE WARNING SYSTEM

(71) Applicant: 3M INNOVATIVE PROPERTIES COMPANY, St. Paul, MN (US)

(72) Inventors: Ganesh P. D. Kannan, Bangalore (IN); Santhosh Kumar Rajendran, Bangalore (IN)

(73) Assignee: 3M Innovative Properties Company, St. Paul, MN (US)

( * ) Notice: Subject to any disclaimer, the term of this patent is extended or adjusted under 35 U.S.C. 154(b) by 769 days.

(21) Appl. No.: 17/606,480

(22) PCT Filed: Apr. 28, 2020

(86) PCT No.: PCT/IB2020/054006

§ 371 (c)(1),
(2) Date: Oct. 26, 2021

(87) PCT Pub. No.: WO2020/222124

PCT Pub. Date: Nov. 5, 2020

(65) Prior Publication Data

US 2022/0195679 A1 Jun. 23, 2022

(30) Foreign Application Priority Data

Apr. 30, 2019 (IN) ..... 201941017125

(51) Int. Cl.
*E01F 9/529* (2016.01)
*E01F 9/582* (2016.01)

(52) U.S. Cl.
CPC ..... *E01F 9/529* (2016.02); *E01F 9/582* (2016.02)

(58) Field of Classification Search
CPC ..... E01F 9/529; E01F 9/582
See application file for complete search history.

(56) References Cited

U.S. PATENT DOCUMENTS

D248,841 S 8/1978 Montigny
D251,967 S 5/1979 Montigny
(Continued)

FOREIGN PATENT DOCUMENTS

BE 1010301 5/1998
CA 47891 2/1981
(Continued)

OTHER PUBLICATIONS

International Search Report for PCT International Application No. PCT/IB2020/054006, mailed on Aug. 17, 2020, 2 pages.

*Primary Examiner* — Abigail A Risic

(57) ABSTRACT

A road obstacle warning system (A) includes a plurality of road units (1) and a power supply means for powering the road unit (1) through a main supply line (7). The road units (1) are disposed one adjacent to another on a road surface and configured to interconnect with each other. The road unit (1) includes a top body (2) and at least two shanks (3). The system (A) also includes at least one lighting element (4) comprising optical parameters for carrying light internally in order to glow the entire lighting element (4). The power supply means include any external power source include a solar power system, a step down power supply, a stored battery power supply or any other generated power supply. The road unit (1) is also powered by a wireless power source through induction means.

15 Claims, 8 Drawing Sheets

(56) References Cited

U.S. PATENT DOCUMENTS

| | | | | |
|---|---|---|---|---|
| D266,060 | S | 9/1982 | Beretta | |
| D266,554 | S | 10/1982 | Beretta | |
| D267,933 | S | 2/1983 | Luckinbill | |
| D270,143 | S | 8/1983 | Flanagan | |
| D301,209 | S | 5/1989 | Sakko | |
| D311,704 | S | 10/1990 | May | |
| D320,759 | S | 10/1991 | Sakko | |
| D326,060 | S | 5/1992 | Sakko | |
| D326,424 | S | 5/1992 | Sakko | |
| D327,230 | S | 6/1992 | Hedgewick | |
| D328,262 | S | 7/1992 | Sakko | |
| D329,990 | S | 10/1992 | Plummer | |
| D339,080 | S | 9/1993 | Gartlacher | |
| D346,757 | S | 5/1994 | Allan | |
| D346,984 | S | 5/1994 | Hedgewick | |
| D348,411 | S | 7/1994 | Hedgewick | |
| D357,205 | S | 4/1995 | Sandino | |
| D357,206 | S | 4/1995 | Weid | |
| D360,601 | S | 7/1995 | Weid | |
| 5,554,907 | A * | 9/1996 | Dixon | E01F 9/529 340/936 |
| D382,826 | S | 8/1997 | Sakko | |
| 5,661,374 | A * | 8/1997 | Cassidy | H05B 39/044 315/307 |
| D385,809 | S | 11/1997 | Chen | |
| D386,434 | S | 11/1997 | Sandino | |
| D386,706 | S | 11/1997 | Khieu | |
| D388,353 | S | 12/1997 | Desborough | |
| 5,927,845 | A * | 7/1999 | Gustafson | B64F 1/205 362/153.1 |
| 6,010,277 | A | 1/2000 | Follman | |
| D422,523 | S | 4/2000 | Weid | |
| D422,932 | S | 4/2000 | Khieu | |
| D426,169 | S | 6/2000 | Hedgewick | |
| 6,113,248 | A * | 9/2000 | Mistopoulos | F21S 4/20 362/240 |
| D470,787 | S | 2/2003 | Kim | |
| D472,489 | S | 4/2003 | Kim | |
| 6,623,206 | B1 * | 9/2003 | Blair | E01F 9/70 404/15 |
| D490,335 | S | 5/2004 | Attar | |
| D492,907 | S | 7/2004 | Attar | |
| 6,866,394 | B1 * | 3/2005 | Hutchins | F21S 4/28 362/249.06 |
| D512,335 | S | 12/2005 | Shou | |
| D514,465 | S | 2/2006 | Shou | |
| D653,139 | S | 1/2012 | Lee | |
| D678,099 | S | 3/2013 | Lee | |
| 8,454,199 | B2 * | 6/2013 | Deng | F21V 19/0055 362/249.06 |
| 9,175,840 | B2 * | 11/2015 | Patti | F21S 4/28 |
| 2003/0053307 | A1 * | 3/2003 | Talamo | E01F 9/30 362/240 |
| 2003/0133750 | A1 | 7/2003 | Kim | |
| 2005/0238425 | A1 | 10/2005 | Safar | |
| 2007/0070618 | A1 * | 3/2007 | Talamo | E01F 9/20 362/240 |
| 2009/0003013 | A1 * | 1/2009 | Lee | E01F 9/529 362/582 |
| 2009/0046451 | A1 | 2/2009 | Hoover | |
| 2013/0271014 | A1 | 10/2013 | Dasaratha et al. | |
| 2014/0197955 | A1 | 7/2014 | Martin et al. | |
| 2015/0376849 | A1 | 12/2015 | Thompson | |
| 2017/0097128 | A1 * | 4/2017 | Stafford | F21V 7/00 |
| 2020/0232173 | A1 * | 7/2020 | De Bettignies | E01F 9/559 |
| 2020/0370254 | A1 * | 11/2020 | Zeh | E01F 9/571 |
| 2020/0393097 | A1 * | 12/2020 | St.Ives | F21S 4/28 |
| 2022/0018734 | A1 * | 1/2022 | Leroy | E01F 9/529 |
| 2023/0002982 | A1 * | 1/2023 | Kim | E01F 9/578 |

FOREIGN PATENT DOCUMENTS

| | | |
|---|---|---|
| CA | 48622 | 9/1981 |
| CA | 89282 | 4/2000 |
| CN | 3249841 | 8/2002 |
| CN | 200978394 | 11/2007 |
| CN | 102280040 | 12/2011 |
| CN | 203361044 | 12/2013 |
| CN | 302959398 | 10/2014 |
| CN | 106585488 | 4/2017 |
| EP | 1698729 | 9/2006 |
| FR | 2596081 | 9/1987 |
| GB | 1055868 | 6/1988 |
| GB | 2004787 | 3/1989 |
| GB | 2009675 | 3/1990 |
| GB | 2011085 | 5/1990 |
| GB | 2011983 | 6/1990 |
| GB | 2055990 | 4/1996 |
| GB | 2304769 | 3/1997 |
| GB | 2312229 | 10/1997 |
| GB | 2087266 | 4/1999 |
| GB | 4022915 | 1/2012 |
| IN | 248706-0001 | 10/2012 |
| IN | 253755-0001 | 5/2013 |
| KR | 101686820 | 12/2016 |
| WO | WO 2008-084122 | 7/2008 |

* cited by examiner

ROAD OBSTACLE WARNING SYSTEM

CROSS REFERENCE TO RELATED APPLICATIONS

This application is a national stage filing under 35 U.S.C. 371 of PCT/IB2020/054006, filed Apr. 28, 2020, which claims the benefit of India application No. 201941017125, filed Apr. 30, 2019, the disclosures of which are incorporated by reference in their entirety herein.

TECHNICAL FIELD

The disclosure generally relates to a system for road obstacle warning, and particularly relates to providing road obstacle warning system that warns the driver of a vehicle about a forthcoming road crossing, obstacle, steep curves, road diversions speed breakers, etc., and a method for installation of the system.

BACKGROUND

Road obstacle warning signs are generally provided to alert the driver of the vehicle about an approaching obstacle on road, where the obstacles include road crossing, obstacles, steep curves, road diversions, speed breakers etc. Introducing road lighting leads to a decrease in the severity of injuries. However, visual reaction times are substantially longer under adverse, low visibility conditions than under optimal conditions, leading to increased stopping distances when driving. High visibility road obstacle warning system is therefore required to warn the driver of the vehicle in good time about a forthcoming obstacle.

SUMMARY

Various aspects and embodiments described herein relate to a road obstacle warning system with reduced risk of threat, injury, fatality, or loss of property of the driver or others on the road surface.

An aspect of the present disclosure relates to a road obstacle warning system, the system including a plurality of road units disposed one adjacent to another on a road surface and configured to interconnect with each other. Each road unit is having a top body including at least two sections, a first section and a second section. The first section and the second section each are having a front end, a back end, a plurality of side faces, a top face and a bottom face. At least two shanks to overhang from the bottom face of the second section of the top body. A power supply means for powering the road unit through a main supply line. The plurality of side faces of the first section extends downwards and outwards at an angle from the top face to the bottom face of the first section. The second section of the top body is configured to affix within the first section. Each of the shank is provided with a conduit extending 5 throughout the center along the longitudinal axis. Each of the shanks is connected at lateral ends of each of the top body that overhang from the bottom face of the second section. The main supply line is provided in one or more grooves along the longitudinal axis of the bottom face of the second section.

Some embodiments relates to a method for installation of a road obstacle warning system on a road surface, the system including a plurality of road units, each road unit having a top body and at least two shanks. The method having steps of measuring the width of the road surface on which the road units to be installed, determining the number of road units to be installed on the road surface, by dividing the measured width with the length of the top body; drilling one or more holes on the road surface; filling each hole with an adhesive and placing at least one shank in each of the hole for drying; and wiring and connecting the shanks to the power supply means through a wire to power the road unit through a main supply line. The power supply means include any external power source include a solar power system, a step down power supply, a stored battery power supply or any other generated power supply. The road unit is also powered by a wireless power source through induction means.

These and other aspects of the present application will be apparent from the detailed description below. In no event, however, should the above summaries be construed as limitations on the claimed subject matter, which subject matter is defined solely by the attached claims.

BRIEF DESCRIPTION OF DRAWINGS

The various aspects of the disclosure will be discussed in greater detail with reference to the accompanying figures where, FIG. 1 schematically shows a road unit to an embodiment.

The figures are not necessarily to scale. Like numbers used in the figures refer to like components. However, it will be understood that the use of a number to refer to a component in a given figure is not intended to limit the component in another figure labeled with the same number.

DETAILED DESCRIPTION OF ILLUSTRATIVE EMBODIMENTS

Figure 1:
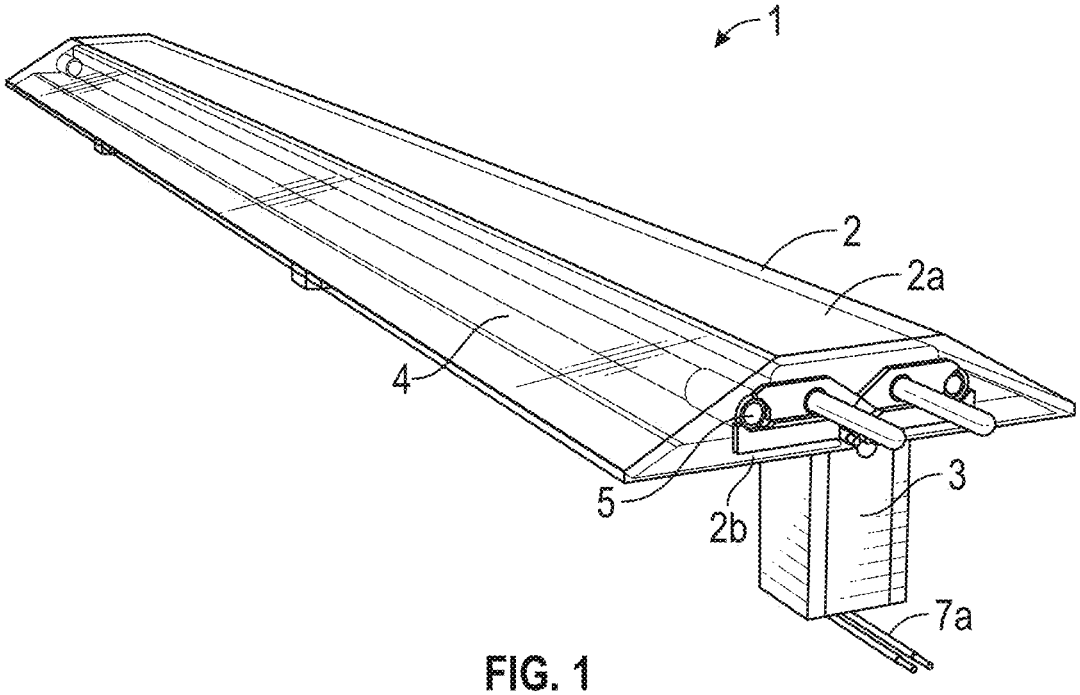
Figure 2:
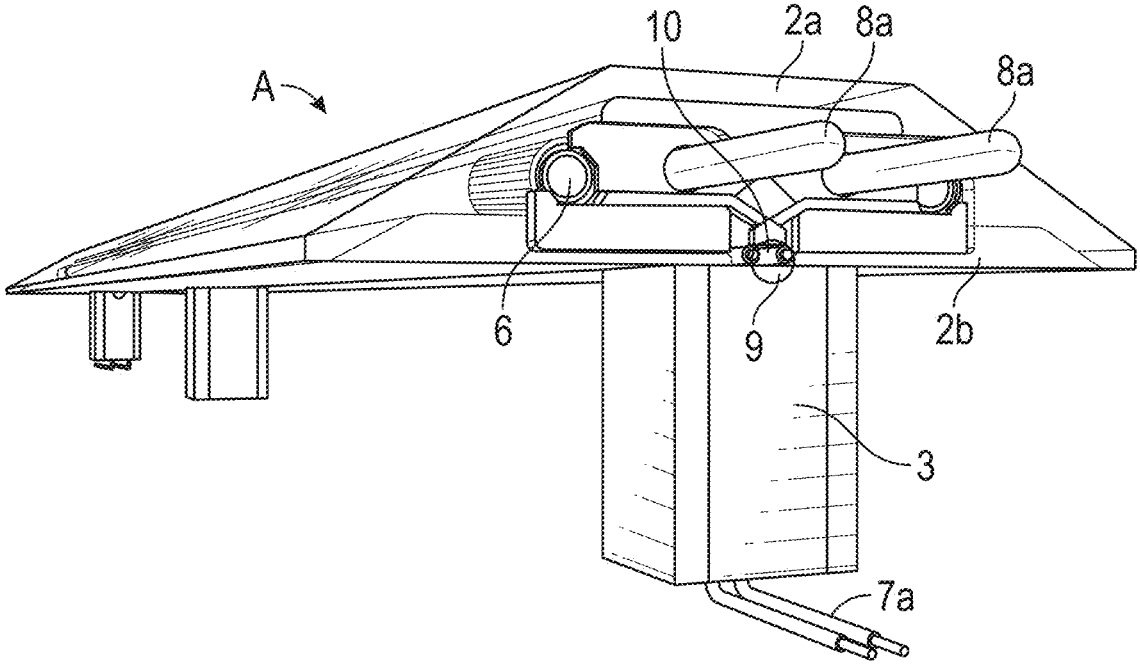
FIG. 2 schematically shows a road obstacle warning system (A) having road units installed adjacent to one another.

Referring to FIGS. 1 and 2 illustrate a road obstacle warning system (A) having a plurality of road units (1) disposed one adjacent to another on a road surface and configured to interconnect with each other. The road obstacle warning system is used for traffic marking across the road for regulating traffic and to provide a durable raised road obstacle warning system with light emitting from one side or from both sides of the road unit (1) surface. The said light emitting is from entire lateral axis of the road unit (1) and is uniformly spread across the whole unit. This provides high visibility to the driver of the vehicle bright enough that is visible from a remarkable distance.

Figure 5A:
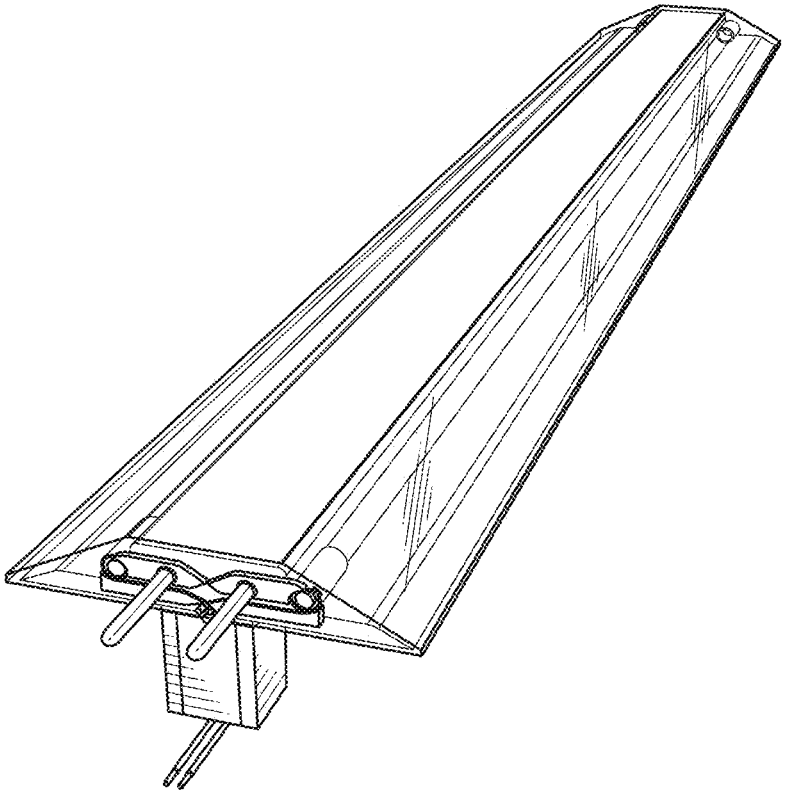
FIGS. 5*a*-5*b* schematically shows a road unit having two lighting elements.
Figure 5B:
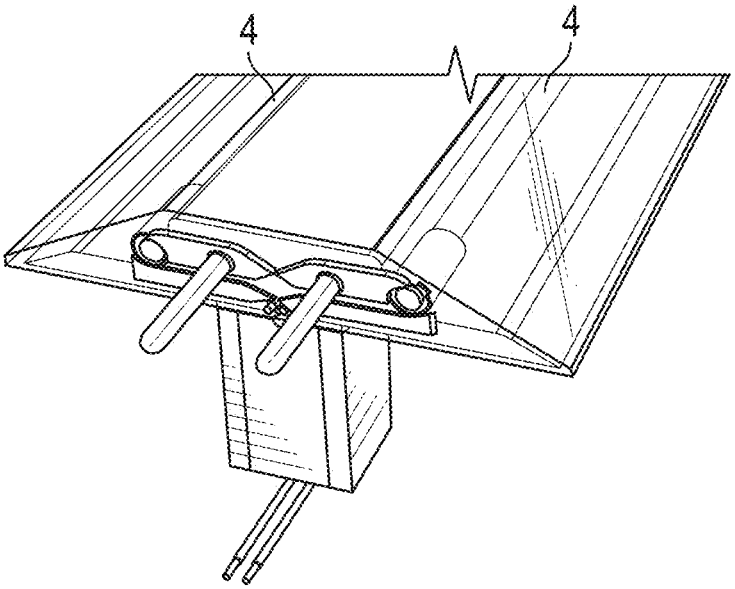

As shown in FIGS. 5*a* and 5*b*, road obstacle warning system (A) including a plurality of road units (1), where each of the road unit (1) having a top body (2), at least two shanks (3) and a power supply means for powering the road unit (1).

Further referring to FIGS. 1 and 2, the top body (2) having at least two sections, a first section (2*a*) and a second section (2*b*) wherein the first section (2*a*) and the second section (2*b*) each having a front end, a back end, a plurality of side faces, a top face and a bottom face as shown in FIGS. 1 and 2. The plurality of side faces of the first section (2*a*) extends downwards and outwards at an angle from the top face to the bottom face of the first section (2*a*) as shown in FIG. 1. The second section (2*b*) of the top body (2) is configured to affix within the first section (2*a*). Further, the first section (2*a*) and the second section (2*b*) are affixed by co-extrusion or over molding process.

The top body (2) of the road unit (1) also includes a predefined area, a recess (5), a through hole (6) and at least one lighting element (4) as shown in FIG. 2. The predefined area is provided along the length of at least one of the plurality of side faces of the first section (2*a*), where the predefined area is transparent so that the light emitting from the road unit (1) is visible to the oncoming traffic. Further, the top body (2) is made of transparent material to allow the light from the lighting element (4) to be visible to the oncoming traffic. The top body (2) redirects the compressive and shears impact forces to the base of the top body and dissipate the frictional force toward the rear of the top body.

A recess (5) provided along the length of at least one of the plurality of side faces of the second section (2*b*) as shown in FIG. 1. A through hole (6) provided laterally across at least one of the plurality of side faces of the first section (2*a*). The through hole (6) is accommodated within the recess (5) throughout the length of at least one of the plurality of side faces of the second section (2*b*). The recess (5) is provided with a path to accommodate a main supply line (7) to power the lighting element (4).

Further, the top body (2) also includes a lighting element (4) laterally extended within the through hole (6) of the first section (2*a*) as shown in FIGS. 1 and 2. Each lighting element (4) further having optical properties to carry light internally throughout the lighting element (4) from one end to the other end and leaks a part of its light to outer surface in order to glow the entire lighting element (4). Each lighting element (4) is provided with an injector (4*a*) for terminating at its front end and the rear end. The injector (4*a*) accommodates a light emitting diode (LED) (4*b*) for emitting light into the lighting element (4) as shown in FIG. 4.

In certain embodiments, the top body (2) is profiled as an extruded trapezoidal profile with two tapered edges to the front and the rear.

Figure 4:
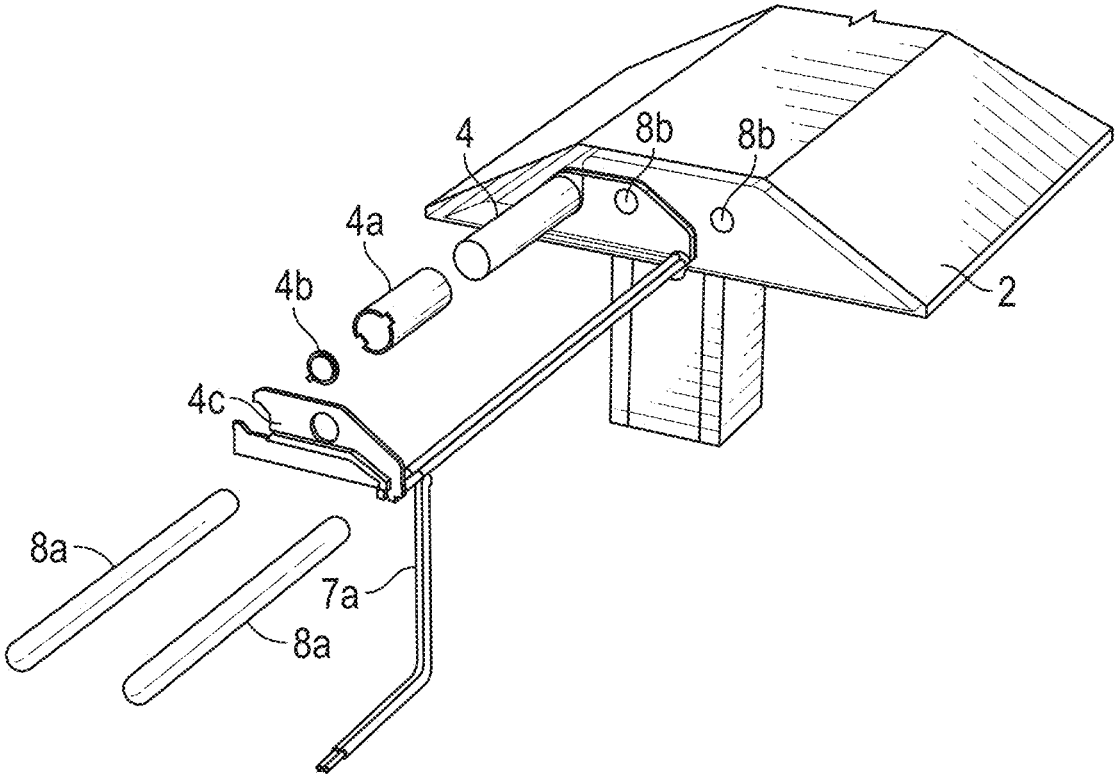
FIG. 4 shows an exploded view of a lighting element along 5 with its parts and a means for interlocking.

The injector (4*a*) of the lighting element (4) together with the LED (4*b*) is mounted on a mount plate (4*c*) and fitted to at least one of the front end or the back end of the second section (2*b*) of the top body (2) as shown in FIG. 4. The LED (4*b*) is flashed in a periodic pattern at a constant rate by employing a flasher module. The flasher module of the lighting element (4) is configured for flashing the LED (4*b*) of the lighting element (4) in a periodic pattern at a predetermined frequency, where the frequency of the flasher module is set according to the requirements.

In some embodiments, the road obstacle warning system (A) can be provided with one or more lighting elements (4).

In certain embodiments, the flasher module may include a transistor or an IC based relay or a timer circuit that allows the LEDs (4*b*) to flash in a periodic pattern at a predetermined frequency. In certain aspects, the frequency of the flasher module may be controlled through a circuit as per the requirements.

As shown in FIGS. 1 and 2, the shanks (3) of the road unit (1) overhangs from the bottom face of the second section (2*b*) of the top body (2). Each of the shank (3) is provided with a conduit extending throughout the center along the longitudinal axis and each of the shanks (3) is connected at lateral ends of each of the top body (2) that overhang from the bottom face of the second section (2*b*), specifically at front end and back end of the bottom face of the second section (2*b*) as shown in FIG. 2.

In some embodiments, the profile of the shank (3) is of 5 any geometric shape. In some embodiments, the top body (2) and the shank (3) of the road unit are made of highly durable material with compressive load performance.

Figure 3:
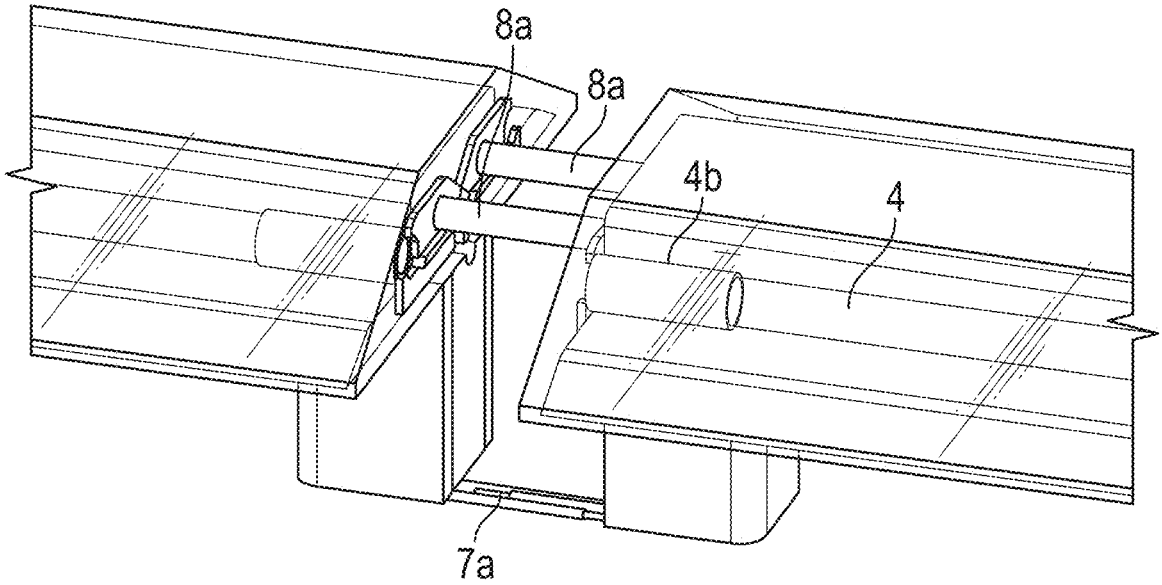
FIG. 3 schematically shows a means for interlocking a top body with adjacent top body when placed on a road surface.

Referring to FIGS. 3 and 4, the top body (2) is provided with one or more protrusions (8*a*) at the front end or at the back end of the second section (2*b*) for accommodating a means (8*b*). The means (8*b*) of the top body (2) is connected to the protrusions of the adjacent top body of the other road unit to interconnect with the adjacent top body at its second section as shown in FIG. 3.

Figure 6:
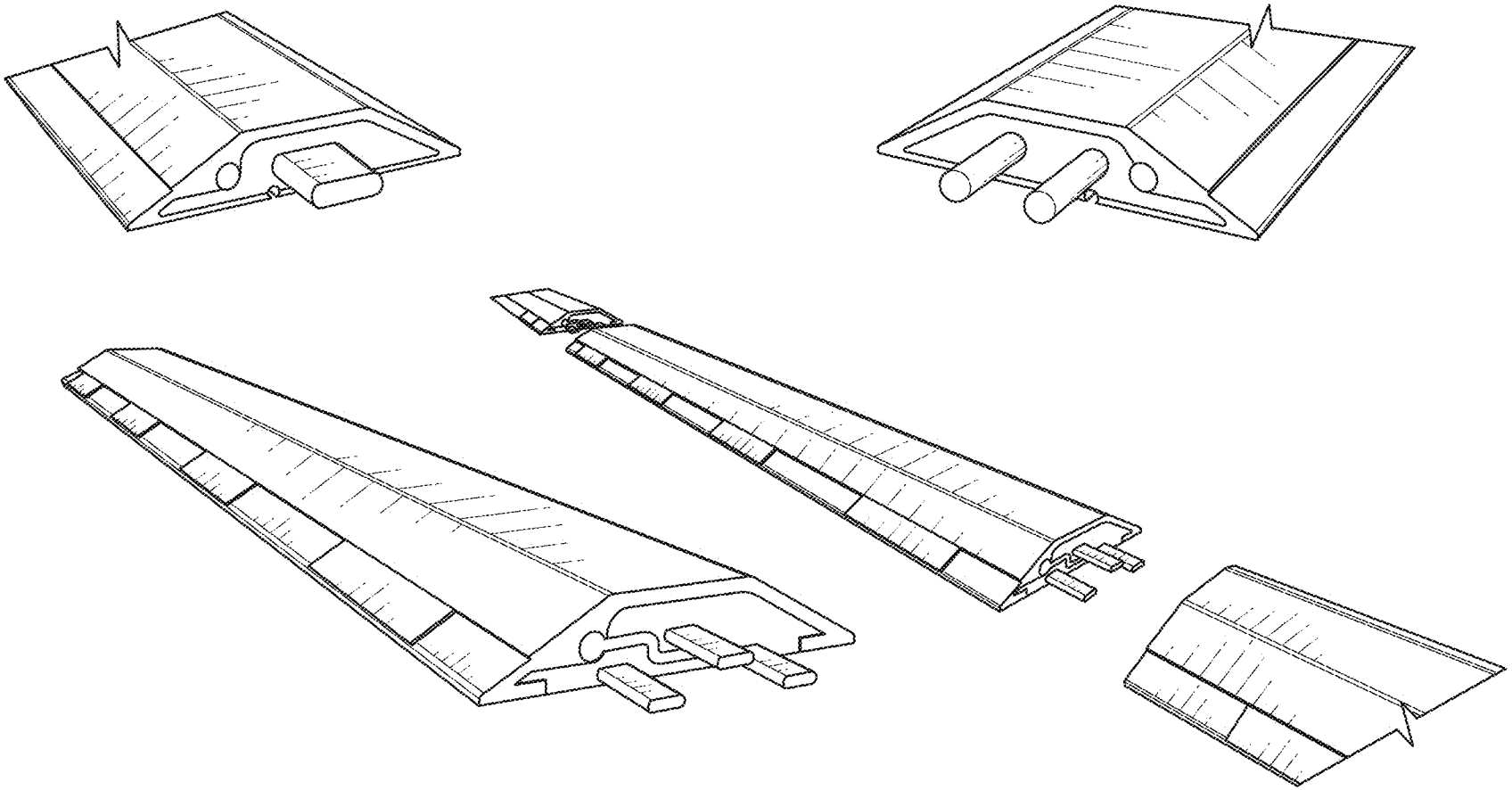
FIG. 6 schematically shows a various shapes and sizes of interlocking means for a top body.
Figure 7A:
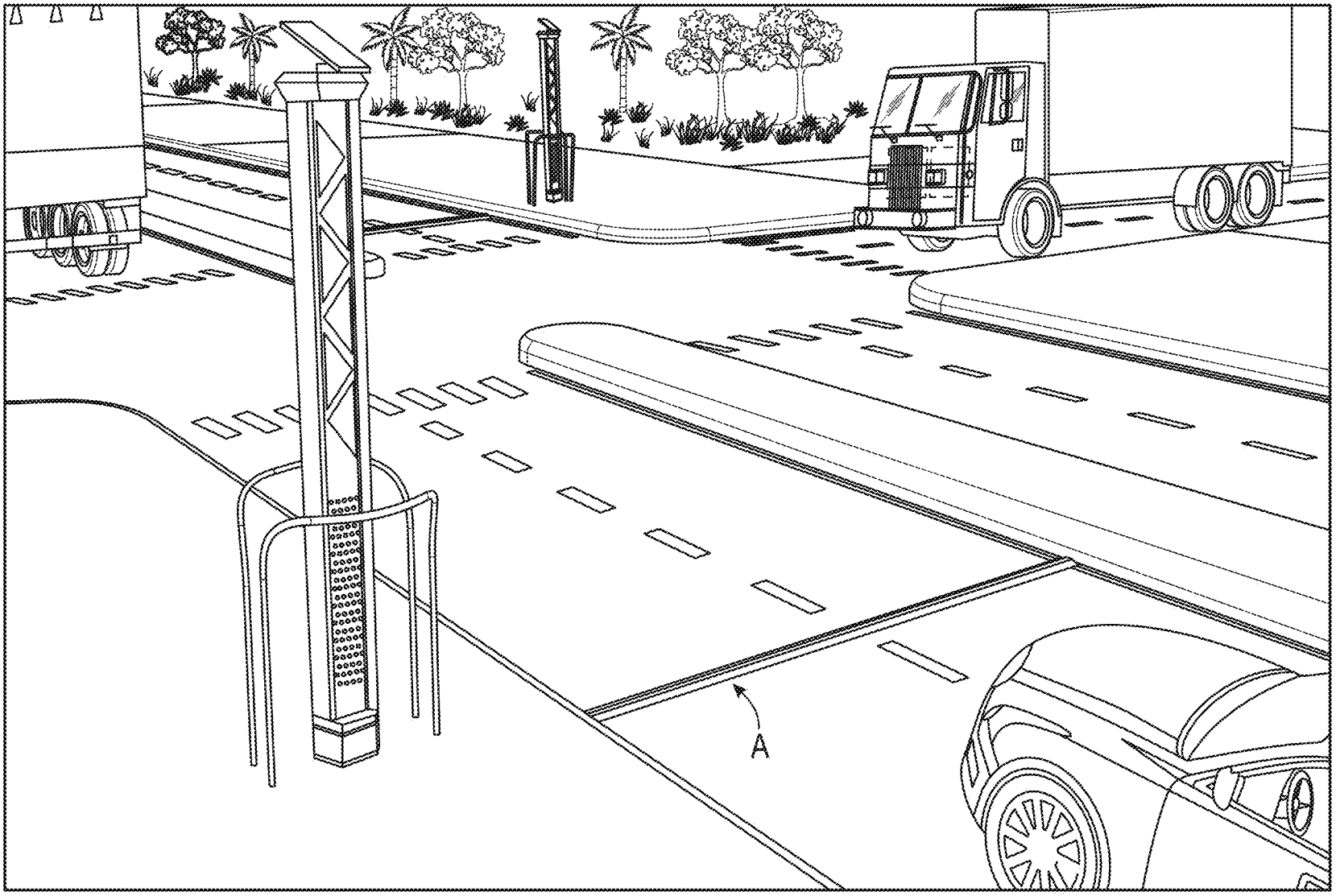
FIGS. 7*a*-7*g* schematically shows a road obstacle warning system to be installed on a road surface for alerting the driver regarding forthcoming obstacles.
Figure 7B:
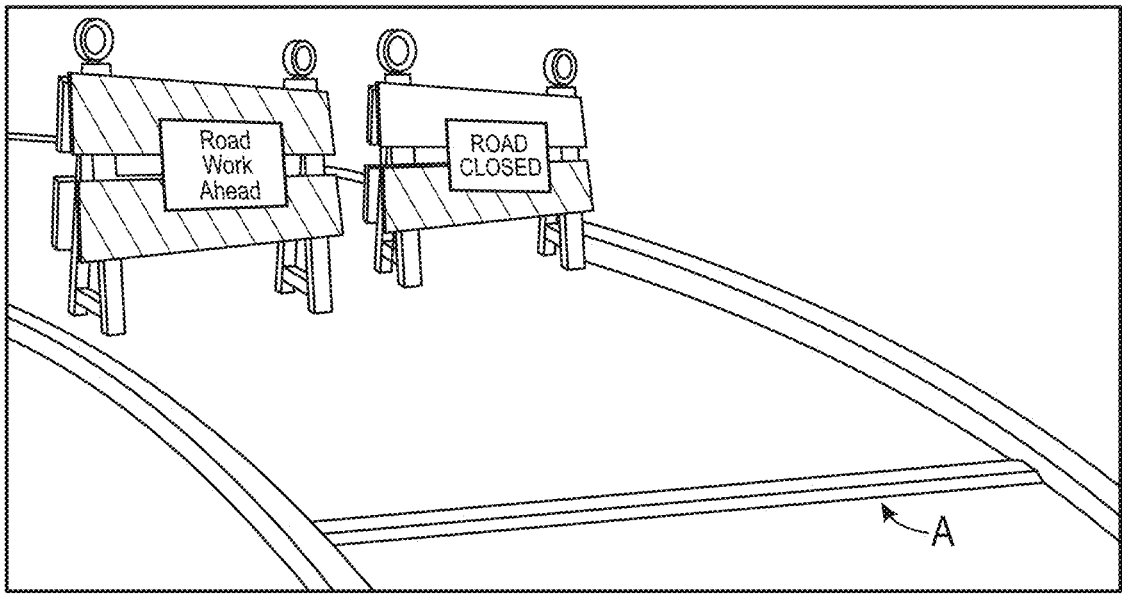
Figure 7C:
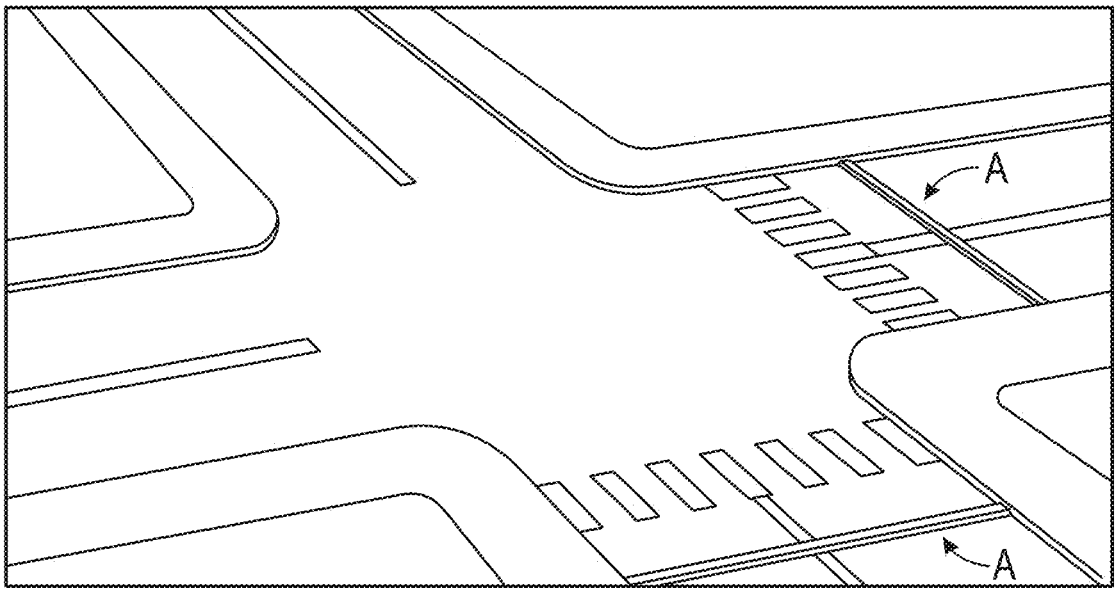
Figure 7D:
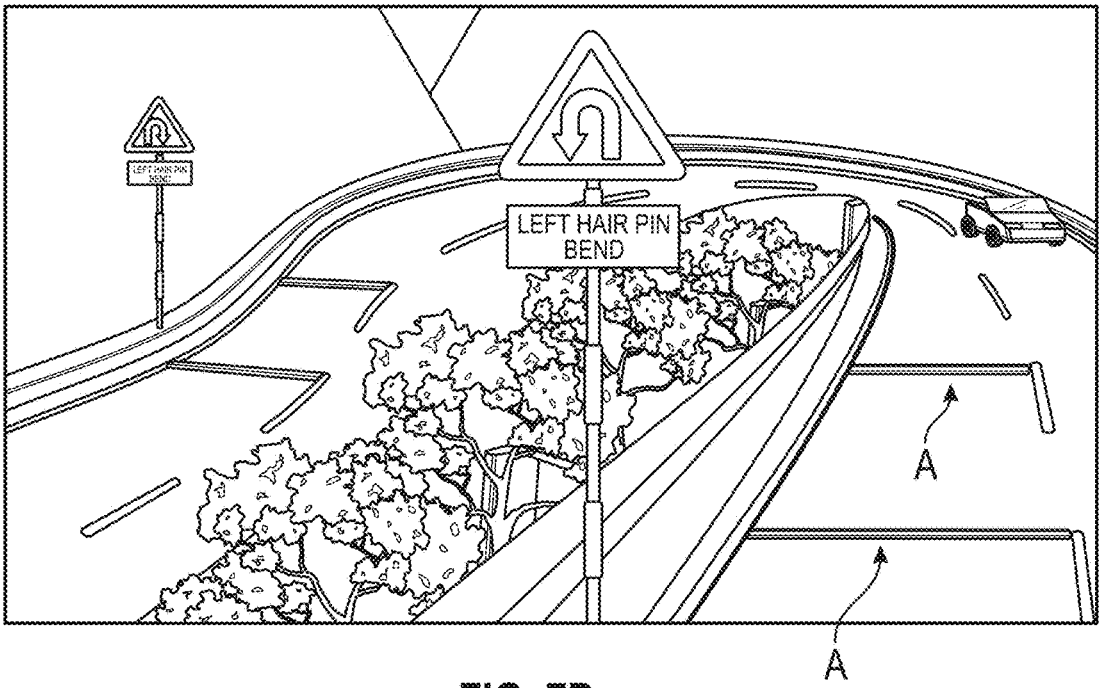
Figure 7E:
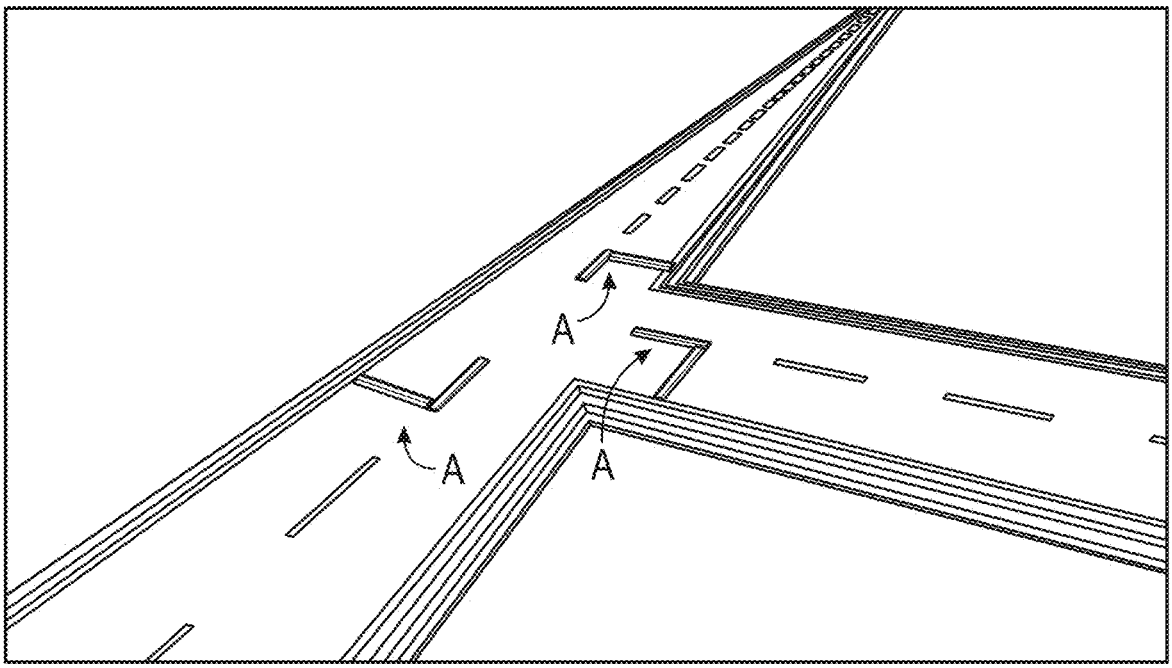
Figure 7F:
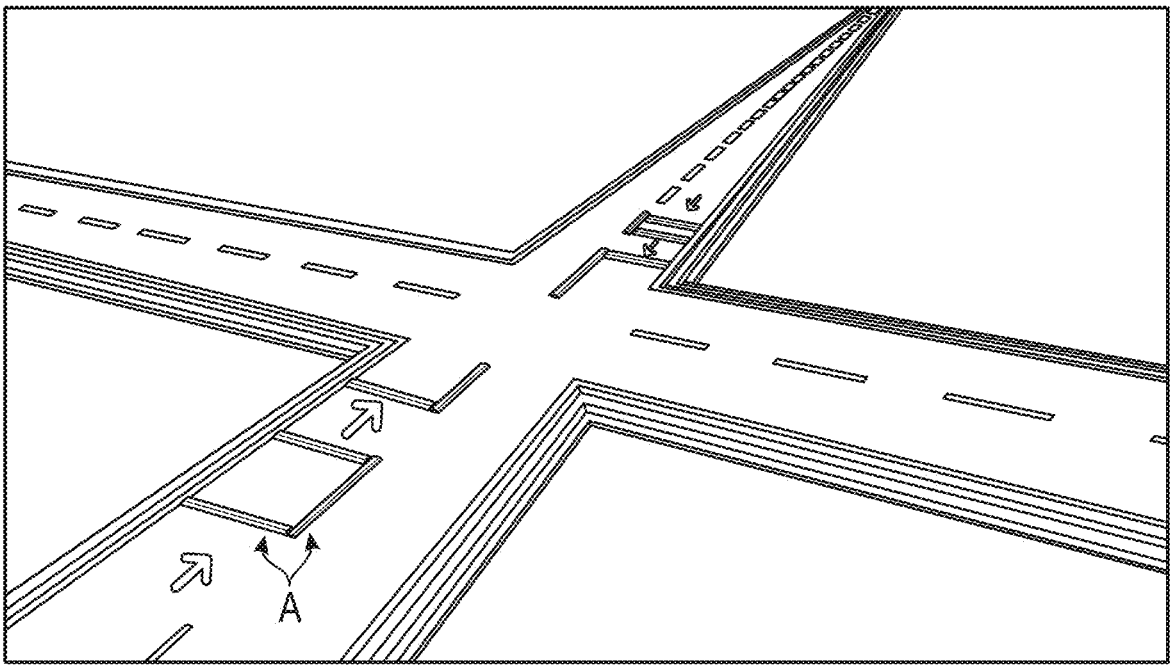
Figure 7G:
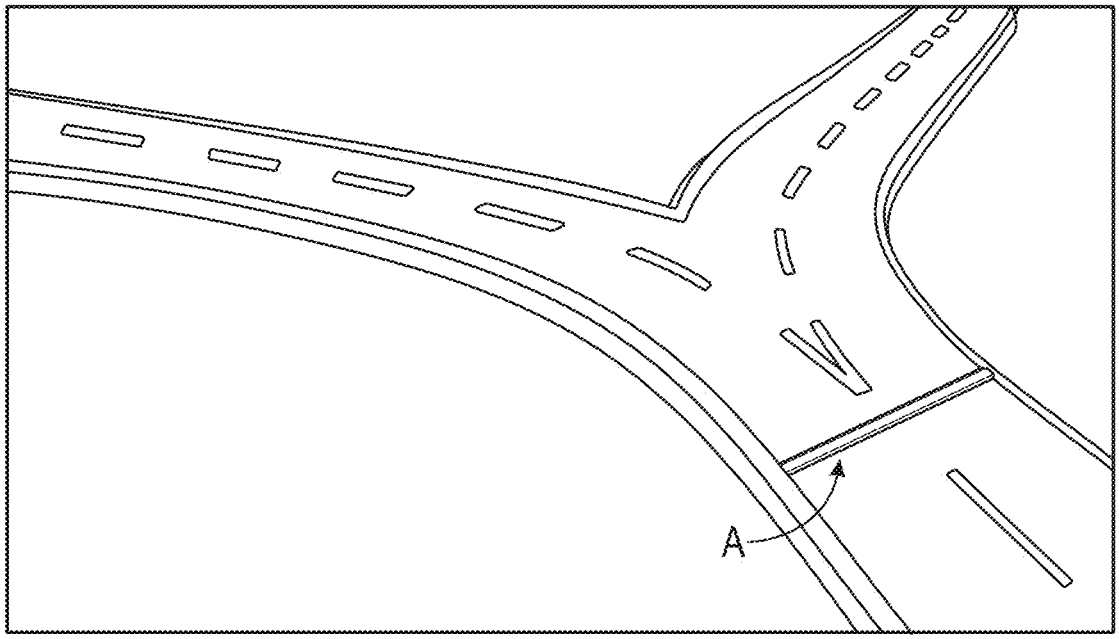

In certain embodiments, the means (8*b*) for interlocking include dowel pins or studs. In certain aspects, the shape and number of protrusions (8*a*) and means (8*b*) vary according to the length of the road unit (1) as exemplarily shown in FIG. 6.

Further, the road unit (1) is provided with a wire (7*a*) is provided in one or more grooves (9) provided along the horizontal axis on the top face of each of the shank (3), where the wire (7*a*) is configured to connect to the main supply line (7) as shown in FIGS. 1 to 4. The grooves (10) of the bottom face of the second section (2*b*) lines up with the grooves (9) on the top face of the shank (3) to incorporate the wire (7*a*) and the ends of the wire (7*a*) are terminated with a connector.

In certain embodiments, the power supply means of the road unit (1) include any external power source that includes a solar power system, a step down power supply, a stored battery power supply or any other generated power supply. In some embodiments, the road is powered by a wireless power source through induction means.

In certain embodiments, the method of installing a road obstacle warning system (A) having a plurality of road units (1), each road unit (2) having a top body (2) and at least two shanks (3), having a step-by-step process of measuring the width of the road surface on which the road units (1) to be installed. Further step include, determining the number of road units (1) to be installed on the road surface, by dividing the measured width with the length of the top body (2). Further step include, drilling one or more holes on the road surface. Further step include, filling each hole with an adhesive and placing at least one shank (3) in each of the hole for drying and wiring and connecting the shanks (3) to the power supply means through a wire (7*a*) to power the road unit (1) through a main supply line (7).

In some embodiments, the power supply means include any external power source include a solar power system, a step down power supply, a stored battery power supply or any other generated power supply. Also in some embodiments, the road unit (1) is also powered by a wireless power source through induction means.

After installing one or more of the road units (1) on the road surface, each of the top body (1) is interlocked with a means (8*b*) provided on it. The means (8*b*) for interlocking include dowel pins or studs. Further, after installation of the road units (1) the shanks (3) prevent the rotation of the top body (2) as shown in FIGS. 3 and 4.

In certain embodiments, the road obstacle warning system is installed on a road surface for indicating the driver of a vehicle a road junction, road crossing, a road closed/road work ahead indication, pedestrian crossing, steep u-turn, an intersection warning, junction warning, slow down warning as exemplarily illustrated in FIGS. 7*a*-7*g* for reducing the risk of threat, injury, fatality, or loss of property of the driver or others on the road surface.

Embodiments Disclosed Herein Include

Embodiment 1: A road obstacle warning system, the system including a plurality of road units disposed one adjacent to another on a road surface and configured to interconnect with each other, wherein each road unit having a top body including at least two sections, a first section and a second section; wherein the first section and the second section each having a front end, a back end, a plurality of side faces, a top face and a bottom face; at least two shanks to overhang from the bottom face of the second section of the top body; and a power supply means for powering the road unit through a main supply line, wherein the plurality of side faces of the first section extends downwards and outwards at an angle from the top face to the bottom face of the first section, the second section of the top body is configured to affix within the first section, each of the shank provided with a conduit extending throughout the center along the longitudinal axis, each of the shanks connected at lateral ends of each of the top body that overhang from the bottom face of the second section, and the main supply line is provided in one or more grooves along the longitudinal axis of the bottom face of the second section.

Embodiment 2. The system of embodiment 1, wherein the top body of the road unit comprising at least one lighting element provided on at least one of the plurality of side faces of the first section, where each lighting element is laterally extended within a through hole provided in the first section, wherein the through hole is provided on at least one of the plurality of side faces of the first section, a recess is provided along the length of at least one of the plurality of side faces of the second section to accommodate the through hole, a predefined area covering each lighting element is transparent, and the recess is provided with a path to accommodate a main supply line to power the lighting element.

Embodiment 3. The system of embodiment 2, wherein each lighting element of the top body including: optical properties to carry light internally throughout the lighting element from one end to the other end; leaks a part of its light to outer surface in order to glow the entire lighting element; and an injector for terminating the front end and the rear end of the lighting element, and wherein the injector accommodates a light emitting diode (LED) for emitting light into the lighting element.

Embodiment 4. The system of embodiment 3, wherein the injector together with the LED is mounted on a mount plate and fitted to at least one of the front end or the back end of the second section of the top body.

Embodiment 5. The system of embodiment 4, wherein the 5 LED is flashed in a periodic pattern at a constant rate by employing a flasher module.

Embodiment 6. The system of embodiment 5, wherein the flasher module is configured for flashing the LED of the lighting element in a periodic pattern at a predetermined frequency, where the frequency of the flasher module is set according to the requirements.

Embodiment 7. The system of embodiment 1, wherein at least one of the shank to overhang at the front end and the back end of the bottom face of the second section.

Embodiment 8. The system of embodiment 7, wherein the profile of the shank is of any geometric shape.

Embodiment 9. The system of embodiment 1, wherein one or more protrusions are provided at the front end or at the back end of the second section of the top body for accommodating a means.

Embodiment 10. The system of embodiment 9, wherein the means of the top body is connected to the protrusions of the adjacent top body of the other road unit to interconnect with the adjacent top body at its second section.

Embodiment 11. The system of embodiments 9 or 10, wherein the means for interlocking include dowel pins or studs.

Embodiment 12. The system of embodiments 9 to 11, wherein the shape and number of protrusions and means vary according to the length of the road unit.

Embodiment 13. The system of embodiment 1, wherein a wire is provided in one or more grooves provided along the horizontal axis on the top face of each of the shank, where the wire is configured to connect to the main supply line.

Embodiment 14. The system of embodiments 1 or 13, wherein the grooves of the bottom face of the second section lines up with the grooves on the top face of the shank to incorporate the wire.

Embodiment 15. The system of embodiment 14, wherein the ends of the wire are terminated with a connector.

Embodiment 16. The system of embodiment 1, wherein the power supply means include any external power source include a solar power system, a step down power supply, a stored battery power supply or any other generated power supply.

Embodiment 17. The system of embodiment 1, wherein the road unit is also powered by a wireless power source through induction means.

Embodiment 18. The system of embodiment 1, wherein the top body and the shank are made of highly durable material with compressive load performance.

Embodiment 19. The system of embodiment 1, wherein the top body is made of transparent material.

Embodiment 20. The system of embodiment 1, wherein the first section and the second section are affixed by co-extrusion or over molding process.

Embodiment 21. The system of embodiment 1, wherein the top body redirect the compressive and shear impact forces to the base of the top body and dissipate the frictional force toward the rear of the top body.

Embodiment 22. A method for installation of a road obstacle warning system on a road surface, the system having a plurality of road units, each road unit having a top body and at least two shanks, the method having steps of measuring the width of the road surface on which the road units to be installed; determining the number of road units to be installed on the road surface, by dividing the measured width with the length of the top body; drilling one or more holes on the road surface; filling each hole with an adhesive and placing at least one shank in each of the hole for drying; and wiring and connecting the shanks to the power supply means through a wire to power the road unit through a main supply line, wherein the power supply means include any external power source include a solar power system, a step down power supply, a stored battery power supply or any other generated power supply, and the road unit is also powered by a wireless power source through induction means.

Embodiment 23. The method of embodiment 22, wherein after installing one or more of the road units on the road surface, each of the top body is interlocked with a means provided on it.

Embodiment 24. The method of embodiment 23, wherein the means for interlocking include dowel pins or studs.

Embodiment 25. The method of embodiment 22, wherein after installation of the road units the shanks prevent the rotation of the top body.

Descriptions for elements in figures should be understood to apply equally to corresponding elements in other figures, unless indicated otherwise. Although specific embodiments have been illustrated and described herein, it will be appreciated by those of ordinary skill in the art that a variety of alternate and/or equivalent implementations can be substituted for the specific Embodiments shown and described without departing from the scope of the present disclosure. This application is intended to cover any adaptations or variations of the specific Embodiments discussed herein. Therefore, it is intended that this disclosure be limited only by the claims and the equivalents thereof.

We claim:

1. A road obstacle warning system (A), the system comprising:

a plurality of road units (1) disposed one adjacent to another on a road surface and configured to interconnect with each other, wherein each road unit (1) comprises:

a top body (2) comprising at least two sections, a first section (2*a*) and a second section (2*b*); wherein the first section (2*a*) and the second section (2*b*) each having a front end, a back end, a plurality of side faces, a top face and a bottom face;

at least two shanks (3) to overhang from the bottom face of the second section (2*b*) of the top body (2); and a power supply means for powering the road unit (1) through a main supply line (7), wherein the plurality of side faces of the first section (2*a*) extends downwards and outwards at an angle from the top face to the bottom face of the first section (2*a*), the second section (2*b*) of the top body (2) is configured to affix within the first section (2*a*), each of the shanks (3) provided with a conduit extending throughout the center along the longitudinal axis, each of the shanks (3) connected at lateral ends of each of the top body (2) that overhang from the bottom face of the second section (2*b*), and the main supply line (7) is provided in one or more grooves (10) along the longitudinal axis of the bottom face of the second section (2*b*).

2. The system (A) as claimed in claim 1, wherein the top body (2) of the road unit (1) comprises at least one lighting element (4) provided on at least one of the plurality of side faces of the first section (2*a*), where each lighting element (4) is laterally extended within a through hole (6) provided in the first section (2*a*), wherein the through hole (6) is provided on at least one of the plurality of side faces of the first section (2*a*), a recess (5) is provided along the length of at least one of the plurality of side faces of the second section (2*b*) to accommodate the through hole (6), a predefined area covering each lighting element (4) is transparent, and the recess (5) is provided with a path to accommodate a main supply line (7) to power the lighting element (4).

3. The system (A) as claimed in claim 2, wherein each lighting 5 element (4) of the top body (2) comprises:

optical properties to carry light internally throughout the lighting element (4) from one end to the other end;

leaks a part of its light to outer surface in order to glow the entire lighting element (4);

and an injector (4*a*) for terminating the front end and the rear end of the lighting element (4), and wherein the injector (4*a*) accommodates a light emitting diode (LED) (4*b*) for emitting light into the lighting element (4).

4. The system (A) as claimed in claim 3, wherein the injector (4*a*) together with the LED (4*b*) is mounted on a mount plate (4*c*) and fitted to at least one of the front end or the back end of the second section (2*b*) of the top body (2).

5. The system (A) as claimed in claim 1, wherein at least one of the shanks (3) to overhang at the front end and the back end of the bottom face of the second section (2*b*).

6. The system (A) as claimed in claim 1, wherein one or more protrusions (8*a*) are provided at the front end or at the back end of the second section (2*b*) of the top body (2) for accommodating a means (8*b*).

7. The system (A) as claimed in claim 6, wherein the means (8*b*) of the top body (2) is connected to the protrusions of the adjacent top body of the other road unit to interconnect with the adjacent top body at its second section.

8. The system (A) as claimed in claim 6, wherein the shape and number of protrusions (8*a*) and means (8*b*) vary according to the length of the road unit (1).

9. The system (A) as claimed in claim 1, wherein a wire (7*a*) is provided in one or more grooves (9) provided along the horizontal axis on the top face of each of the shanks (3), where the wire (7*a*) is configured to connect to the main supply line (7).

10. The system (A) as claimed in claim 1, wherein the grooves (10) of the bottom face of the second section (2*b*) lines up with the grooves (9) on the top face of the shank (3) to incorporate the wire (7*a*).

11. The system (A) as claimed in claim 1, wherein the top body (2) and the shank (3) are made of highly durable material with compressive load performance.

12. The system (A) as claimed in claim 1, wherein the top body (2) is made of transparent material.

13. The system (A) as claimed in claim 1, wherein the first section (2*a*) and the second section (2*b*) are affixed by co-extrusion or over molding process.

14. The system (A) as claimed in claim 1, wherein the top body (2) redirect the compressive and shear impact forces to the base of the top body and dissipate the frictional force toward the rear of the top body.

15. A method for installation of a road obstacle warning system (A) on a road surface, the system (A) comprising a plurality of road units (1), each road unit (2) having a top body (2) and at least two shanks (3), the method comprising steps of:

measuring the width of the road surface on which the road units (1) to be installed;

determining the number of road units (1) to be installed on the road surface, by dividing the measured width with the length of the top body (2);

drilling one or more holes on the road surface;

filling each hole with an adhesive and placing at least one shank (3) in each of the holes for drying; and wiring and connecting the shanks (3) to a power supply means through a wire (7*a*) to power the road unit (1) through a main supply line (7), wherein the power supply means include any external power source include a solar power system, a step down power supply, a stored battery power supply or any other generated power supply, and the road unit (1) is also powered by a wireless power source through induction means.

* * * * *